US009983491B2

(12) United States Patent
Onishi et al.

(10) Patent No.: US 9,983,491 B2
(45) Date of Patent: May 29, 2018

(54) PROCESS FOR PRODUCING A TONER

(71) Applicant: Konica Minolta, Inc., Tokyo (JP)

(72) Inventors: Junya Onishi, Tokyo (JP); Shiro Hirano, Tokyo (JP); Noboru Ueda, Tokyo (JP); Kouji Sugama, Tokyo (JP); Aya Shirai, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/439,435

(22) Filed: Feb. 22, 2017

(65) Prior Publication Data

US 2017/0255114 A1 Sep. 7, 2017

(30) Foreign Application Priority Data

Mar. 1, 2016 (JP) ..... 2016-038844

(51) Int. Cl.
*G03G 9/08* (2006.01)

(52) U.S. Cl.
CPC ..... *G03G 9/0804* (2013.01); *G03G 9/0815* (2013.01); *G03G 9/0825* (2013.01)

(58) Field of Classification Search
CPC .... G03G 9/0804; G03G 9/081; G03G 9/0815; G03G 9/0825
See application file for complete search history.

(56) References Cited

U.S. PATENT DOCUMENTS 7,494,757 B2 2/2009 Sacripante et al.
2003/0049554 A1* 3/2003 Ohmura ..... G03G 9/0804 430/110.2
2003/0104296 A1* 6/2003 Hamano ..... G03G 9/0804 430/107.1
2007/0254229 A1* 11/2007 Patel ..... G03G 9/0804 430/108.4
2011/0086302 A1* 4/2011 Zhou ..... G03G 9/0804 430/105
2013/0209931 A1* 8/2013 Sato ..... G03G 9/0804 430/109.4
2014/0302437 A1* 10/2014 Shimano ..... G03G 9/0806 430/137.15
2014/0356780 A1* 12/2014 Kawamura ..... G03G 9/08724 430/109.3

FOREIGN PATENT DOCUMENTS

JP 2001222138 A 8/2001
JP 2009063992 A 3/2009
JP 2012042508 A 3/2012
JP 2012098697 A 5/2012
JP 2014211632 A 11/2014

* cited by examiner

*Primary Examiner* — Christopher D RoDee
(74) *Attorney, Agent, or Firm* — Lucas & Mercanti, LLP

(57) ABSTRACT

A process for producing a toner of the present invention includes: a first step of heating a dispersion containing an aqueous medium and a binder resin containing a crystalline resin to a temperature higher than or equal to a melting point of the crystalline resin; and a second step of maintaining the dispersion at temperature T (° C.) for 30 minutes or longer in a state where a pH of the dispersion is maintained at 5.5 or higher and 9.0 or lower, in which the temperature T satisfies the following expression, $Rc-25 \leq T \leq Rc-5$, where the Rc represents a recrystallization temperature (° C.) of the crystalline resin.

16 Claims, 1 Drawing Sheet

PROCESS FOR PRODUCING A TONER

CROSS REFERENCE TO RELATED APPLICATIONS

This application is entitled to and claims the benefit of Japanese Patent Application No. 2016-038844, filed on Mar. 1, 2016, the disclosure of which including the specification, drawings and abstract is incorporated herein by reference in its entirety.

BACKGROUND OF THE INVENTION

1. Field of the Invention

The present invention relates to a process for producing a toner for development of electrostatic images.

2. Description of Related Art

To increase printing speed and achieve further saving of energy for reduction of environmental loads in electrophotographic image forming apparatuses, a toner for development of electrostatic images (hereinafter, simply referred to as "toner") which is capable of heat fixing at lower temperatures has been recently required. Such a toner needs lowering of the melting temperature and melt viscosity of a binder resin, and a toner having low-temperature fixability enhanced by adding a crystalline resin such as a crystalline polyester resin is suggested (e.g., see Japanese Patent Application Laid-Open No. 2001-222138). When a toner containing a crystalline resin is heated to a temperature higher than or equal to the melting point of the crystalline resin in production of the toner, however, the crystalline resin becomes compatible with an amorphous resin even in production, which inconveniently deteriorates the high-temperature storability.

Annealing (hereinafter, also referred to as heat treatment) is known as means for enhancing the high-temperature storability of a toner having such a composition. For example, it is reported that heat treatment at a temperature higher than or equal to the glass transition temperature of an amorphous resin and lower than or equal to the melting point of a crystalline resin—10° C. for a long duration allows the crystalline resin which is compatible with the amorphous resin to recrystallize to enhance the high-temperature storability (e.g., see Japanese Patent Application Laid-Open No. 2009-063992).

In addition, there is known a method of controlling the heating/retaining temperature for an aqueous dispersion of a crystalline resin of a block polymer (e.g., see Japanese Patent Application Laid-Open No. 2014-211632). According to the document, this method enables control of the crystalline resin domain even in recrystallization of the crystalline resin, and thus the crystalline resin domain can be finely dispersed to prevent deterioration of fixability.

Further, it is reported that heating and retaining of a toner composition containing a binder resin containing a crystalline polyester under predetermined conditions allows the toner to keep the low-temperature fixability and high-temperature storability for a long period (e.g., see Japanese Patent Application Laid-Open No. 2012-42508). Furthermore, a method is known in which a differential scanning colorimetry curve is obtained in measurement for a crystalline polyester resin by using a differential scanning colorimeter and heat treatment is performed at the onset temperature±5° C. of an endothermic peak in the curve (e.g., see Japanese Patent Application Laid-Open No. 2012-98697). Moreover, there is known heat treatment of a toner particle containing a crystalline resin and an amorphous resin at a temperature which is higher than or equal to the glass transition temperature of the crystalline resin and is the recrystallization temperature±10° C. (e.g., see U.S. Pat. No. 7,494,757).

In dry heat treatment, however, the elevation of the glass transition temperature, the increase of the domain diameter of a crystalline resin in a toner, etc., are caused due to the change of the moisture adsorption state of a toner, and this makes it difficult to exhibit low-temperature fixing performance at a level required in recent years. Also, when heat treatment is conducted in an aqueous medium, a crystalline resin may be exposed in a surface of a toner. The exposure of a crystalline resin in a surface of a toner may lower surface resistance of the toner and/or deteriorate charging characteristics of the toner, resulting in an image noise, such as density unevenness of images.

Thus, in a related-art process for production of a toner, there remains room for a further investigation from the viewpoint of achieving low-temperature fixability of a toner and suppressing density unevenness of images to be obtained.

SUMMARY OF THE INVENTION

An object of the present invention is to provide a toner which has excellent low-temperature fixability and is capable of suppressing density unevenness of images to be obtained.

The present inventors have found that proper control of a domain diameter and a presence state of a crystalline resin in a toner is important to obtain a toner which has excellent low-temperature fixability and is capable of suppressing density unevenness of images. Further, in a process for production of a toner by an emulsion aggregation method in which a toner base particle is produced by aggregating and fusing fine particles of a binder resin containing a crystalline resin in the presence of a metal ion, a presence state and a domain diameter of the crystalline resin in a toner have been found to be accurately controllable by controlling both a heat treatment scheme of a dispersion containing the toner base particle and a pH of the dispersion during heat treatment. The present invention was made on the basis of such findings.

In order to achieve the object mentioned above, a process for producing a toner, reflecting one aspect of the present invention includes: a first step of heating a dispersion containing an aqueous medium and a binder resin containing a crystalline resin to a temperature higher than or equal to a melting point of the crystalline resin in a production step for forming a toner base particle by aggregating and fusing a fine particle of the binder resin containing the crystalline resin in the presence of a metal ion; and a second step of maintaining the dispersion at temperature T (° C.) for 30 minutes or longer in a state where a pH of the dispersion is maintained at 5.5 or higher and 9.0 or lower, in which the temperature T satisfies the following expression, $Rc-25 \leq T \leq Rc-5$, where the Rc represents a recrystallization temperature (° C.) of the crystalline resin.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1A:
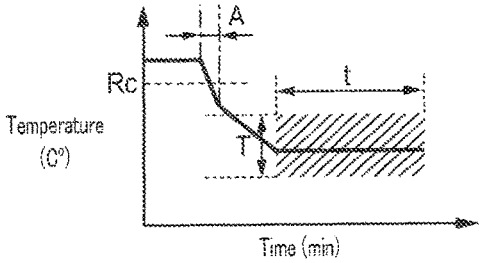
FIG. 1A is a graph showing a first example of the temperature change of a dispersion from after the end of the first step to the end of the second step of the present invention.

In the following, embodiments of the present invention will be described.

A process for producing a toner according to the present embodiment includes: 1) a first step of heating a dispersion containing an aqueous medium and a binder resin containing a crystalline resin to a temperature higher than or equal to a melting point of the crystalline resin in a production step for forming a toner base particle by aggregating and fusing a fine particle of the binder resin containing the crystalline resin in the presence of a metal ion; and 2) a second step of maintaining the dispersion at temperature T (° C.) for 30 minutes or longer in a state where a pH of the dispersion is maintained at 5.5 or higher and 9.0 or lower, in which the temperature T satisfies the following expression, $Rc-25 \leq T \leq Rc-5$, where the Rc represents a recrystallization temperature (° C.) of the crystalline resin.

Each step will be described in the following.

[First Step]

The first step is a step of heating a dispersion containing the binder resin and an aqueous medium to a temperature higher than or equal to a melting point (Tm) of the crystalline resin in the toner base particle. The temperature of the dispersion in the first step is not limited and may be any temperature higher than or equal to a melting point of the crystalline resin, and the upper limit is the boiling point of the aqueous medium (e.g., the boiling point of water). For heating the dispersion, a known heating apparatus such as a heater may be used. The melting point of the crystalline resin can be measured in differential scanning calorimetry (hereinafter, also simply referred to as DSC) to be described later.

[Aqueous Medium]

The aqueous medium refers to a medium having a water content of 50 mass % or more. Examples of components other than water include water-soluble organic solvents such as methanol, ethanol, isopropanol, butanol, acetone, methyl ethyl ketone, and tetrahydrofuran. Among them, alcohol organic solvents which do not dissolve resins therein are particularly preferred, such as methanol, ethanol, isopropanol, and butanol.

[Toner Base Particle]

The toner base particle is formed by aggregating and fusing fine particles of a binder resin containing a crystalline resin in the presence of a metal ion. For example, dispersing fine particles of a binder resin containing a crystalline resin and an aggregating agent to be described below in an aqueous medium, and heating the prepared dispersion can aggregate and fuse the fine particles of the binder resin.

[Aggregating Agent]

In a process for producing a toner according to the present embodiment, an aggregating agent is used for aggregating fine particles of the binder resin. The aggregating agent may be selected from metal salts in the light of growing particles by charge neutralization reaction and crosslinking action.

Examples of the metal salts include salts of monovalent metals including alkali metals, such as sodium, potassium, and lithium; salts of divalent metals, such as calcium, magnesium, manganese, and copper; and salts of trivalent metals such as iron and aluminum. Specific examples of the metal salts include sodium chloride, potassium chloride, lithium chloride, calcium chloride, magnesium chloride, zinc chloride, copper sulfate, magnesium sulfate, and manganese sulfate. Among them, it is particularly preferred to use salts of divalent metals because they can promote aggregation in a smaller amount. One of them may be used singly, or two or more thereof may be used in combination.

The aggregating agent added allows fine particles of a binder resin to bond together through ionic crosslinking in the aqueous medium, and thus the presence state of the crystalline resin can be more advantageously controlled in heat treatment.

The growth of an aggregated particle can be substantially terminated by raising the salt concentration of an aqueous medium. For example, sodium chloride, or a polyvalent organic acid or a salt thereof, an amino acid or a salt thereof, a polyphosphonic acid or a salt thereof may be used as an aggregation terminator. Alternatively, aggregating action can be reduced by changing the pH in the system. For pH adjustment, for example, an aqueous solution of sodium fumarate, an aqueous solution of sodium hydroxide, or hydrochloric acid, may be used. In addition, use of a chelating agent in combination with pH adjustment is also effective for reducing crosslinking action of a metal ion. Examples of such chelating agents include HIDA (hydroxyethyliminodiacetic acid), HEDTA (hydroxyethylethylenediaminetriacetic acid), HEDP (hydroxyethylidenediphosphonic acid), and HIDS (3-hydroxy-2,2'-iminodisuccinic acid).

The average circularity of a toner base particle to be obtained can be controlled in an aging step for aging of a toner base particle. In an aging step, a dispersion of a toner base particle is heated to age the toner base particle until an intended average circularity of the toner base particle is obtained.

The toner base particle may have a core-shell structure. In the case that a toner base particle having a core-shell structure is formed, a shell layer is formed on the surface of a toner base particle as a core particle. Specifically, a resin to constitute a shell layer is dispersed in an aqueous medium to prepare a resin particle dispersion, which is added to a dispersion of a toner base particle obtained in a formation step or aging step for a toner base particle to aggregate and fuse the resin particle as a shell layer on the surface of the toner base particle. In this way, a dispersion of a toner base particle having a core-shell structure can be obtained. To aggregate and fuse the resin particles as the shell layer on the core particle more strongly, heat treatment may be performed after the shell formation step. Heat treatment is suitably performed until an intended average circularity of the toner base particle is obtained.

For aggregation/fusion reaction, an additional toner material other than the binder resin may be further added to the dispersion of the fine particles of the binder resin, as long as the advantageous effects of the present embodiment are exerted. Examples of toner materials other than the binder resin include a coloring agent, a release agent, a charging-controlling agent, and a surfactant, each to be described later. One or more of the additional components may be contained. In the case that an additional toner material is added, a dispersion separately prepared and containing a fine particle of an additional toner material such as a coloring agent may be mixed with the dispersion containing the fine particles of the binder resin for the aggregation/fusion reaction.

Although the toner base particle produced as described above may be taken out of the dispersion before being subjected to a later step, the toner base particle is preferably subjected to a later step while being kept in the dispersion.

[Fine Particle of Binder Resin]

The fine particles of the binder resin can be produced by using an emulsion polymerization method in which a monomer of a resin is added to an aqueous medium together with a polymerization initiator and the monomer is allowed to undergo polymerization reaction to obtain a dispersion of resin particles. The emulsion polymerization method can be performed in multiple stages. In the case of polymerization reaction in three stages, for example, a dispersion of resin particles is prepared in the first stage of polymerization, and a monomer of a resin and a polymerization initiator are further added in the dispersion for the second stage of polymerization. To the dispersion prepared in the second stage of polymerization, a monomer of a resin and a polymerization initiator are further added for the third stage of polymerization. In the second and third stages of polymerization, a newly added monomer can be additionally polymerized with the resin particles generated in the previous polymerization, as seeds, in the dispersion, and thus the particle size, etc., of the resin particles can be made uniform. Use of a different monomer in each stage of polymerization reaction can provide the resin particles with a multilayer structure and readily provide resin particles having intended characteristics.

(Polymerization Initiator)

A known polymerization initiator may be used in the polymerization reaction, and examples thereof include persulfates such as ammonium persulfate, sodium persulfate, and potassium persulfate; azo compounds such as 2,2'-azobis(2-aminodipropane) hydrochloride, 2,2'-azobis-(2-aminodipropane) nitrate, 4,4'-azobis-4-cyanovaleric acid, and poly(tetraethylene glycol-2,2'-azobisisobutyrate); and peroxides such as hydrogen peroxide. The amount of the polymerization initiator to be added depends on intended molecular weight and molecular weight distribution, and specifically, can be 0.1 to 5.0 mass % based on the amount of a polymerizable monomer added.

(Chain Transfer Agent)

A chain transfer agent may be added in the polymerization reaction from the viewpoint of controlling the molecular weight of the resin particles. Examples of chain transfer agents which can be used include mercaptans such as octyl mercaptan; and mercaptopropionates such as n-octyl 3-mercaptopropionate. The amount of the chain transfer agent to be added depends on intended molecular weight and molecular weight distribution, and specifically, can be 0.1 to 5.0 mass % based on the amount of a polymerizable monomer added.

(Surfactant)

A surfactant may be added in the polymerization reaction from the viewpoint of preventing the aggregation of the resin fine particle in the dispersion, etc., to maintain a satisfactory dispersion state. Examples of such surfactants include known surfactants including cationic surfactants such as dodecylammonium bromide and dodecyltrimethylammonium bromide; anionic surfactants such as sodium stearate, sodium lauryl sulfate (sodium dodecyl sulfate), and sodium dodecylbenzenesulfonate; and nonionic surfactants such as dodecyl polyoxyethylene ether and hexadecyl polyoxyethylene ether. One of them may be used singly, or two or more thereof may be used in combination.

[Second Step]

The second step is a step of maintaining the dispersion obtained in the first step at temperature T (° C.) for 30 minutes or longer in a state where a pH of the dispersion is maintained at 5.5 or higher and 9.0 or lower, in which the temperature T satisfies the following expression, $Rc-25 \leq T \leq Rc-5$, where the Rc represents a recrystallization temperature (° C.) of the crystalline resin (hereinafter, simply referred to as "heat treatment").

This means, in the second step, the temperature of the dispersion is maintained at a temperature higher than or equal to Rc−25° C. and lower than or equal to Rc−5° C. for 30 minutes or longer in a state where a pH of the dispersion is maintained at 5.5 or higher and 9.0 or lower.

Rc, which is a temperature at which crystallization of a crystalline resin progresses at the greatest level, is a value determined as a peak top temperature of an exothermic peak in a measurement curve obtained in a temperature-lowering operation in DSC in which the temperature of a crystalline resin is raised from room temperature to 100° C. at a temperature-elevating rate of 10° C./min, retained for 1 minute, and lowered to 0° C. at a temperature-lowering rate of 0.1° C./min. The reason for setting the temperature-lowering rate to 0.1° C./min is that the crystallization temperature obtained at a temperature-lowering rate as low as possible is highly correlated with the performance of a toner obtained by using the process for producing a toner according to the present embodiment and the temperature-lowering rate of 0.1° C./min provides a sufficient correlation.

During the heat treatment, as long as temperature T(° C.) of the dispersion satisfies $Rc-25 \leq T \leq Rc-5$, a mode of the temperature change of the dispersion from the start to the end of the heat treatment is not limited. For example, the temperature of the dispersion during the heat treatment may be maintained constant, kept elevating or lowering at a constant rate, or constantly changed by repeated elevation and lowering or the like.

When a pH of the dispersion during the heat treatment is lower than 5.5, bleeding out of a crystalline resin into the vicinity of a surface of a toner base particle occurs due to a low amount of ionic crosslinking among aggregated fine particles of a binder resin, and charging characteristics and so forth of a toner deteriorate, resulting in density unevenness of images to be obtained. In contrast, when a pH of the dispersion during the heat treatment is higher than 9.0, an amount of ionic crosslinking among aggregated fine particles of a binder resin increases excessively and deteriorates low-temperature fixability of a toner.

From the viewpoint of enhancing low-temperature fixability of a toner and suppressing density unevenness of images, a pH of the dispersion during the heat treatment is preferably 6.0-8.0.

When a pH of the dispersion is 5.5 or higher and 9.0 or lower at the time of completion of the first step, no pH adjustment of the dispersion is needed. When a pH of the dispersion is lower than 5.5, the pH may be adjusted to 5.5 or higher and 9.0 or lower by a known method, such as addition of a sodium hydroxide solution. When a pH of the dispersion is higher than 9.0, the pH may be adjusted to 5.5 or higher and 9.0 or lower by a known method, such as addition of a hydrochloric acid solution.

The pH of the dispersion is measured using, for example, a glass electrode-type pH meter (from DKK-TOA Corporation) at a pre-heat treatment step temperature.

In addition, temperature T of the heat treatment preferably satisfies $Rc-25 \leq T \leq Rc-10$ from the viewpoint of the enhancement of the low-temperature fixability and suppressed density unevenness of images. Moreover, the duration of the heat treatment may be 30 minutes or longer, and the upper limit of the duration of the heat treatment may preferably be about 180 minutes from the viewpoint of production efficiency although the upper limit is not particularly limited. Further, heat treatment in an aqueous medium can suppress change in adsorption state of water molecules in a toner and consequently suppress elevation of a glass transition temperature of a binder resin.

[Cooling Step]

A dispersion, obtained in the first step, having been heated to a temperature higher than Rc may be adjusted to a temperature lower than Rc (pre-heat treatment step temperature) at an arbitrary temperature-lowering rate by, for example, spontaneous cooling. From the viewpoint of suppressing density unevenness of images, the dispersion is more preferably cooled to a temperature lower than Rc−25° C.

In the cooling step, it is preferable to rapidly cool the dispersion having been heated to a temperature higher than Rc at a temperature-lowering rate (cooling rate) of 1° C./min or higher to a temperature lower than Rc. During this, the dispersion may be cooled at a temperature-lowering rate of 1° C./min or higher at Rc. Before conducting the second step, cooling the dispersion having been heated to a temperature higher than Rc so that a temperature-lowering rate at Rc is 1° C./min or higher can better control a domain diameter and a presence state of a crystalline resin in a toner. Accordingly, low-temperature fixability of a toner to be obtained can be further enhanced and density unevenness of images can be suppressed as well.

"The temperature of the dispersion having been heated to a temperature higher than Rc" may be the temperature at the end of the first step, or a predetermined temperature higher than Rc to which the dispersion is cooled from the temperature at the end of the first step. Accordingly, the dispersion having been heated in the first step may be immediately cooled to a temperature lower than Rc at a temperature-lowering rate of 1° C./min or higher, or the dispersion may be cooled to a predetermined temperature higher than Rc at an arbitrary cooling rate and then cooled to a temperature lower than Rc at a temperature-lowering rate of 1° C./min or higher. In addition, the cooling rate after reaching Rc is not limited. For example, the cooling rate may be controlled to lower than 1° C./min after the dispersion is cooled to a predetermined temperature lower than Rc at a temperature-lowering rate of 1° C./min or higher.

The dispersion can be cooled by using a known cooler capable of providing the above cooling rate. For example, an outer bath of a reaction vessel may be quickly cooled, or the dispersion may be allowed to pass through a heat exchanger, or cooled deionized water may be fed into the dispersion. From the viewpoint of production efficiency, cooling with a heat exchanger is preferred.

The cooling rate at Rc for the dispersion is preferably 2° C./min or higher from the viewpoint of the further enhancement of the low-temperature fixability of the toner. From the viewpoint of the further enhancement of the low-temperature fixability of the toner, the higher the cooling rate is, the better it is, so the cooling rate is more preferably 5° C./min or higher. If the cooling rate is too high, however, few crystal nuclei are formed in cooling and crystallization progresses more slowly, and thus the upper limit of the cooling rate is preferably 25° C./min or lower from the viewpoint of productivity.

[Description of Temperature Change of Dispersion from after End of First Step to End of Second Step]

Examples of the temperature change of the dispersion from after the end of the first step to the end of the second step of the present embodiment will be described in the following with reference to FIGS. 1A to 1F. In the accompanying drawings, T indicates a temperature region of higher than or equal to Rc−25° C. and lower than or equal to Rc−5° C., t indicates a duration of 30 minutes or longer, A indicates a zone of the step of cooling where cooling rate is 1° C./min or higher, and a shaded area indicates a duration and a temperature range of the second step. In the shaded area, as mentioned above, a pH of the dispersion is 5.5 or higher and 9.0 or lower.

In the first example, as illustrated in FIG. 1A, (1) the dispersion having been heated to a temperature higher than Rc in the first step is cooled to a predetermined temperature lower than Rc (pre-heat treatment temperature) at a cooling rate of 1° C./min or higher, (2) the dispersion is then cooled to a heat treatment initiation temperature in the temperature region T at a cooling rate of lower than 1° C./min, and (3) finally the temperature of the dispersion is retained at the heat treatment initiation temperature for the duration t (the second step).

Figure 1D:
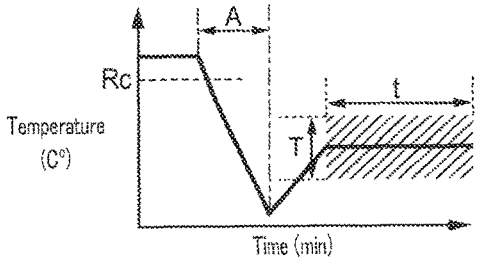
FIG. 1D is a graph showing a fourth example of the temperature change of a dispersion from after the end of the first step to the end of the second step of the present invention.
Figure 1B:
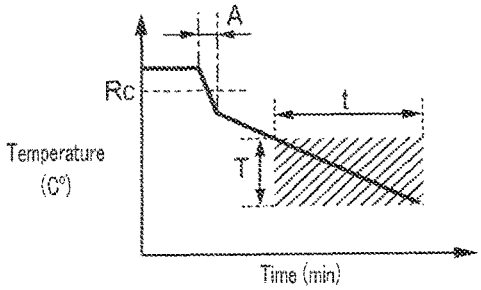
FIG. 1B is a graph showing a second example of the temperature change of a dispersion from after the end of the first step to the end of the second step of the present invention.

In the second example, as illustrated in FIG. 1B, (1) the dispersion having been heated to a temperature higher than Rc in the first step is cooled to a predetermined temperature lower than Rc (pre-heat treatment temperature) at a cooling rate of 1° C./min or higher, (2) the dispersion is then cooled continuously at a cooling rate of lower than 1° C./min and maintained within the temperature region T for the duration t (the second step). In the second example, in contrast to the first example, the temperature of the dispersion is lowered at a constant rate in the second step.

Figure 1E:
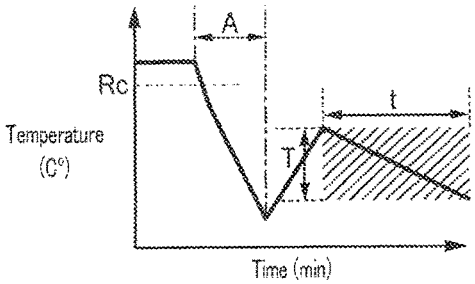
FIG. 1E is a graph showing a fifth example of the temperature change of a dispersion from after the end of the first step to the end of the second step of the present invention.
Figure 1C:
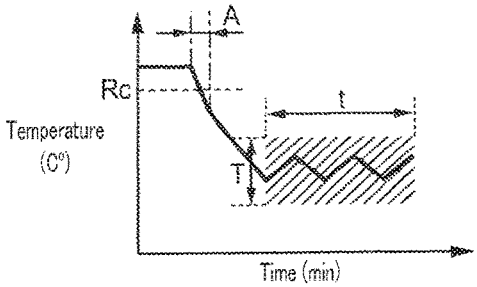
FIG. 1C is a graph showing a third example of the temperature change of a dispersion from after the end of the first step to the end of the second step of the present invention.

In the third example, as illustrated in FIG. 1C, (1) the dispersion having been heated to a temperature higher than Rc in the first step is cooled to a predetermined temperature lower than Rc (pre-heat treatment temperature) at a cooling rate of 1° C./min or higher, (2) the dispersion is then cooled to a heat treatment initiation temperature in the temperature region T at a cooling rate of lower than 1° C./min, and (3) finally the dispersion is repeatedly heated and cooled to elevate and lower the temperature of the dispersion repeatedly in a manner such that the temperature of the dispersion is maintained within the temperature region T for the duration t (the second step). In contrast to the first example and the second example, the temperature of the dispersion is repeatedly elevated and lowered in the second step.

In the fourth example, as illustrated in FIG. 1D, (1) the dispersion having been heated to a temperature higher than Rc in the first step is cooled to a temperature lower than Rc−25° C. (pre-heat treatment temperature) at a cooling rate of 1° C./min or higher, (2) the dispersion is then heated to a heat treatment initiation temperature within the temperature region T, and (3) finally the temperature of the dispersion is retained at the heat treatment initiation temperature for the duration t (the second step). In contrast to the first example, the dispersion having a temperature higher than Rc is cooled to a temperature lower than Rc−25° C. at a cooling rate of 1° C./min or higher, and then heated to the heat treatment initiation temperature.

In the fifth example, as illustrated in FIG. 1E, (1) the dispersion having been heated to a temperature higher than Rc in the first step is cooled to a temperature lower than Rc−25° C. (pre-heat treatment temperature) at a cooling rate of 1° C./min or higher, (2) the dispersion is then heated to a heat treatment initiation temperature of Rc−5° C., and (3) finally the dispersion is continuously cooled in a manner such that the temperature of the dispersion is maintained within the temperature region T for the duration t (the second step). In contrast to the second example, the dispersion having a temperature higher than Rc is cooled to a temperature lower than Rc−25° C. at a cooling rate of 1° C./min or higher, and then heated to the heat treatment initiation temperature.

Figure 1F:
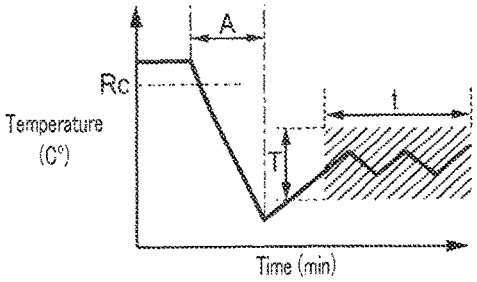
FIG. 1F is a graph showing a sixth example of the temperature change of a dispersion from after the end of the first step to the end of the second step of the present invention.

In the sixth example, as illustrated in FIG. 1F, (1) the dispersion having been heated to a temperature higher than Rc in the first step is cooled to a temperature lower than Rc−25° C. (pre-heat treatment temperature) at a cooling rate of 1° C./min or higher, (2) the dispersion is then heated to a heat treatment initiation temperature within the temperature region T, and (3) finally the dispersion is repeatedly heated and cooled to elevate and lower the temperature of the dispersion repeatedly in a manner such that the temperature of the dispersion is maintained within the temperature region T for the duration t (the second step). In contrast to the third example, the dispersion having a temperature higher than Rc is cooled to a temperature lower than Rc−25° C. at a cooling rate of 1° C./min or higher, and then heated to the heat treatment initiation temperature.

Thus, in the process for producing a toner according to the present embodiment, in a production step of a toner base particle by an emulsion aggregation method in the presence of a metal ion, the temperature of the dispersion containing an aqueous medium and a binder resin containing a crystalline resin is maintained within the range of Rc−25° C. or higher and Rc−5° C. or lower for 30 minutes or longer in a state where a pH of the dispersion is maintained at 5.5 or higher and 9.0 or lower.

The process for producing a toner according to the present embodiment may further include an additional step other than the above-described first and second steps, as long as the advantageous effects of the present embodiment are exerted. Examples of the additional step include a step of mixing an external additive with the resultant toner base particle to allow the external additive to attach to the toner base particle to obtain a toner particle, and a step of mixing the resultant toner particle with a carrier particle to obtain a toner as a two-component developer.

[Toner]

A toner produced by using the production process according to the present embodiment contains, as described above, a toner base particle at least containing a binder resin, and the toner base particle is a particle primarily composed of a binder resin and, as necessary, containing various additives such as a coloring agent, a release agent, a charging-controlling agent, and a surfactant. First, the binder resin will be described.

[Binder Resin]

The binder resin contains a crystalline resin and an amorphous resin. In the present specification, "the binder resin contains a crystalline resin" may refer to a mode in which the binder resin contains a crystalline resin itself, or may refer to a mode in which the binder resin contains a segment in another resin, as a crystalline polyester polymerization segment in a hybrid crystalline resin to be described later. In the present specification, "the binder resin contains an amorphous resin" may refer to a mode in which the binder resin contains an amorphous resin itself, or may refer to a mode in which the binder resin contains a segment in another resin, as an amorphous resin segment in a hybrid crystalline resin to be described later.

(Crystalline Resin)

The crystalline resin is a resin that has a clear endothermic peak, not a stepwise endothermic change, in DSC for a toner. Specifically, a clear endothermic peak refers to an endothermic peak whose full width at half maximum is within 15° C. in DSC carried out at a temperature-elevating rate of 10° C./min. The content of such a crystalline resin is preferably 3 to 30 mass % based on the amount of a toner. This can provide an effect of improving the sharp melting properties of the binder resin to enhance the low-temperature fixability of a toner, and prevent lowering of the heat resistance caused by the crystalline resin contained.

Examples of the crystalline resin include crystalline polyester resins, crystalline polyamide resins, crystalline polyurethane resins, crystalline polyacetal resins, crystalline polyethylene terephthalate resin, crystalline polybutylene terephthalate resin, crystalline polyphenylene sulfide resin, crystalline polyether ether ketone resins, and crystalline polytetrafluoroethylene resin. Among them, crystalline polyester resins are preferred. The reason is that a crystalline polyester resin melts in heat fixation to serve as a plasticizer for an amorphous resin, and thus the low-temperature fixability can be enhanced. Such a crystalline polyester resin can be obtained, for example, by using a known synthesis method through dehydration condensation reaction between a polycarboxylic acid and a polyalcohol. One crystalline polyester resin or more than one crystalline polyester resin may be used.

Examples of the polycarboxylic acid include saturated aliphatic dicarboxylic acids such as succinic acid, sebacic acid, and dodecanedioic acid; alicyclic dicarboxylic acids such as cyclohexanedicarboxylic acid; aromatic dicarboxylic acids such as phthalic acid, isophthalic acid, and terephthalic acid; trivalent or higher polycarboxylic acids such as trimellitic acid and pyromellitic acid; acid anhydrides thereof; and C1-3 alkyl esters thereof. The polycarboxylic acid is preferably an aliphatic dicarboxylic acid.

Examples of the polyalcohol include aliphatic diols such as ethylene glycol, 1,2-propanediol, 1,3-propanediol, 1,4-butanediol, 1,5-pentanediol, 1,6-hexanediol, 1,7-heptanediol, 1,8-octanediol, neopentyl glycol, and 1,4-butenediol; trihydric or higher alcohols such as glycerin, pentaerythritol, trimethylolpropane, and sorbitol. The polyalcohol is preferably an aliphatic diol.

The crystalline polyester resin is preferably a hybrid crystalline resin modified with a styrene-acrylic resin (hereinafter, also simply referred to as "hybrid crystalline resin"). The reason is that the styrene-acrylic resin portion of a hybrid crystalline resin has high compatibility with an amorphous resin and the crystalline polyester resin can be uniformly dispersed in the toner base particle; and in the case that the toner base particle has a core-shell structure to be described later and the shell layer contains a hybrid crystalline resin, the styrene-acrylic resin portion tends to aggregate on the surface of the core particle containing an amorphous resin and cover the whole surface of the core particle.

In the present embodiment, "a crystalline polyester resin is modified with a styrene-acrylic resin" refers to a state in which a crystalline polyester resin segment and a styrene-acrylic resin segment chemically bond to each other. A crystalline polyester resin segment refers to a resin portion derived from a crystalline polyester resin, that is, a molecular chain having the same chemical structure as the crystalline polyester resin, in a hybrid crystalline resin. A styrene-acrylic resin segment refers to a resin portion derived from a styrene-acrylic resin, that is, a molecular chain having the same chemical structure as the styrene-acrylic resin, in a hybrid crystalline resin.

The styrene-acrylic resin is a polymer of a styrenic monomer and a (meth)acrylic monomer.

Examples of the styrenic monomer include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, and derivatives thereof. One of them may be used singly, or two or more thereof may be used in combination.

Examples of the (meth)acrylic monomer include acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl 6-hydroxyacrylate, propyl γ-aminoacrylate, stearyl methacrylate, dimethylaminoethyl methacrylate, diethylaminoethyl methacrylate, 2-hydroxyethyl (meth) acrylate, 2-hydroxypropyl (meth)acrylate, 3-hydroxypropyl (meth)acrylate, 2-hydroxybutyl (meth)acrylate, 3-hydroxybutyl (meth)acrylate, 4-hydroxybutyl (meth)acrylate, and polyethylene glycol mono(meth)acrylate. One of them may be used singly, or two or more thereof may be used in combination.

In addition to the styrenic monomer and the (meth)acrylic monomer, an additional monomer may be used. Examples of the additional monomer which can be used include maleic acid, itaconic acid, cinnamic acid, fumaric acid, monoalkyl maleates, and monoalkyl itaconates.

The styrene-acrylic resin can be obtained by adding an arbitrary common polymerization initiator such as a peroxide, a persulfate, and an azo compound and polymerizing the above-described monomers by a known polymerization method such as bulk polymerization, solution polymerization, an emulsion polymerization method, a miniemulsion method, a suspension polymerization method, and a dispersion polymerization method. In polymerization, a common chain transfer agent such as an alkyl mercaptan and a mercapto fatty acid ester may be used for the purpose of adjusting the molecular weight.

The content of the styrene-acrylic resin segment in the hybrid crystalline resin is preferably 10 mass % or lower from the viewpoint of low-temperature fixability.

The hybrid crystalline resin can be obtained by allowing the crystalline polyester resin and the styrene-acrylic resin each separately prepared to react and chemically bond to each other. From the viewpoint of facilitating bonding, it is preferred to incorporate a substituent capable of reacting with both of the crystalline polyester resin and the styrene-acrylic resin into either the crystalline polyester resin or the styrene-acrylic resin. In formation of the styrene-acrylic resin, for example, a compound having a substituent capable of reacting with a carboxy group (COOH) or a hydroxy group (OH) in the crystalline polyester resin and a substituent capable of reacting with the styrene-acrylic resin is added in addition to the styrenic monomer and the (meth) acrylic monomer as raw materials. This provides a styrene-acrylic resin having a substituent capable of reacting with a carboxy group (COOH) or a hydroxy group (OH) in the crystalline polyester resin.

Alternatively, the hybrid crystalline resin can be obtained by performing polymerization reaction in the presence of the crystalline polyester resin prepared in advance to produce the styrene-acrylic resin, or by performing polymerization reaction in the presence of the styrene-acrylic resin prepared in advance to produce the crystalline polyester resin. In both cases, a compound having a substituent capable of reacting with both of the crystalline polyester resin and the styrene-acrylic resin as described above is suitably added in polymerization reaction.

The number average molecular weight (Mn) of the hybrid crystalline resin is preferably 2,000 to 10,000 from the viewpoint of fixability.

The melting point of the crystalline resin according to the present embodiment is preferably 50 to 90° C., and more preferably 60 to 80° C. from the viewpoint of obtaining sufficient low-temperature fixability and high-temperature storability.

The melting point of the crystalline resin can be measured in DSC. Specifically, a sample of the crystalline resin is sealed in the aluminum pan KITNO.B0143013, and the pan is attached to a sample holder of the thermal analyzer Diamond DSC (from PerkinElmer Inc.), and the temperature is changed by heating, cooling, and heating, in the order presented. In the first and second heating, the temperature is elevated from room temperature (25° C.) to 150° C. at a temperature-elevating rate of 10° C./min and the temperature is retained at 150° C. for 5 minutes, and in the cooling, the temperature is lowered from 150° C. to 0° C. at a temperature-lowering rate of 10° C./min and the temperature is retained at 0° C. for 5 minutes. A peak top temperature of an exothermic peak in an exothermic curve obtained in the second heating is measured as the melting point.

The content of the crystalline polyester resin in the binder resin is preferably 5 to 50 mass %. If the content of the crystalline polyester resin in the binder resin is less than 5 mass %, the effect on low-temperature fixing may be lowered, and if the content of the crystalline polyester resin in the binder resin is more than 50 mass %, the high-temperature storability may be deteriorated. The content of the crystalline resin in the toner base particle is preferably 1 to 20 mass %, and more preferably 5 to 15 mass % from the viewpoint of obtaining sufficient low-temperature fixability and high-temperature storability. An amorphous vinyl resin to be described later can uniformly disperse the crystalline resin whose content is within this range in a toner particle and sufficiently inhibit crystallization.

It is preferable that the weight average molecular weight (Mw) of the crystalline resin according to the present embodiment be 5,000 to 50,000, and the number average molecular weight thereof be 2,000 to 10,000 from the viewpoint of low-temperature fixability and glossiness stability.

The weight average molecular weight and the number average molecular weight can be determined from a molecular weight distribution measured by using gel permeation chromatography (GPC), as in the following.

A sample is added to tetrahydrofuran so that the concentration reaches 1 mg/mL, and dispersed with an ultrasonic disperser at room temperature for 5 minutes, and the resultant dispersion is processed by using a membrane filter with a pore size of 0.2 μm to prepare a sample solution. With use of the GPC apparatus HLC-8120GPC (from Tosoh Corporation) and TSKguardcolumn+TSKgel SuperHZ-M of 3 columns coupled in series (from Tosoh Corporation), tetrahydrofuran as a carrier solvent is allowed to flow through at a flow rate of 0.2 mL/min with the column temperature retained at 40° C. Together with the carrier solvent, 10 μL of the sample solution prepared is injected into the GPC apparatus. The sample is detected with a refractive index detector (RI detector), and the molecular weight distribution of the sample is calculated by using a calibration curve obtained in measurement for a monodisperse polystyrene standard particle. Ten polystyrenes samples are used for determination of the calibration curve.

(Amorphous Resin)

Amorphous resins are resins with amorphous characteristics of having a glass transition temperature (Tg) but having no melting point or clear endothermic peak when the temperature is elevated, as described above, in an endothermic curve obtained in DSC.

The amorphous resin is used as the binder resin together with the crystalline resin, and constitutes the toner base particle. One amorphous resin or more than one amorphous resin may be used. The amorphous resin may be a vinyl resin, or a urethane resin, a urea resin, an amorphous polyester resin or a partially modified polyester resin, or a combination thereof. The amorphous resin is also available, for example, through a known synthesis method. The amorphous resin is preferably a vinyl resin from the viewpoint of the enhancement of the low-temperature stability and high-temperature storability.

(Amorphous Vinyl Resin)

The amorphous vinyl resin is not limited and may be any amorphous vinyl resin obtained by polymerizing a vinyl compound, and examples thereof include acrylate resins, styrene-acrylate resins, and ethylene-vinyl acetate resin. One of them may be used singly, or two or more thereof may be used in combination. Among them, styrene-acrylate resins (styrene-acrylic resins) are preferred in view of plasticity in heat fixation.

The amorphous vinyl resin preferably has a weight average molecular weight of 20,000 to 150,000 and a number average molecular weight of 5,000 to 20,000 from the viewpoint of achieving fixability and hot offset resistance simultaneously. The weight average molecular weight and the number average molecular weight can be measured in the same manner as in the case of the crystalline resin.

The glass transition temperature of the amorphous vinyl resin is preferably 20 to 70° C. from the viewpoint of achieving fixability and high-temperature storability simultaneously. The glass transition temperature can be measured in accordance with the method defined in ASTM (American Society for Testing Materials standard) D3418-82 (DSC method). For measurement, a DSC-7 differential scanning colorimeter (from PerkinElmer Inc.), a TAC7/DX thermal analysis controller (from PerkinElmer Inc.), etc., can be used.

The amorphous vinyl resin may be a polymer consisting only of a monomer or a copolymer consisting of the monomer and an additional monomer. For the additional monomer, a styrenic monomer such as styrene, a styrene derivative, etc., may be used.

(Amorphous Polyester Resin)

Among polyester resins obtained through polycondensation reaction between a divalent or higher carboxylic acid (polycarboxylic acid) and a dihydric or higher alcohol (polyalcohol), amorphous polyester resins are polyester resins with amorphous characteristics. In the case that a toner having a core-shell structure is formed, an amorphous polyester resin may be used for a material of the shell layer.

For the polycarboxylic acid and the polyalcohol, the materials described above for the crystalline polyester resin may be used.

The ratio between the polycarboxylic acid and the polyalcohol is preferably 1.5/1 to 1/1.5, and more preferably 1.2/1 to 1/1.2 in an equivalent ratio of the hydroxy group of the polyalcohol to the carboxy group of the polycarboxylic acid, [OH]/[COOH].

The number average molecular weight of the amorphous polyester resin is preferably 2,000 to 10,000. The number average molecular weight can be measured in the same manner as in the case of the amorphous vinyl resin.

The glass transition temperature of the amorphous polyester resin is preferably 20 to 70° C. The glass transition temperature can be measured in the same manner as in the case of the amorphous vinyl resin.

The amorphous polyester resin may be, as the above-described crystalline polyester resin, a hybrid amorphous polyester resin modified with a styrene-acrylic resin (hereinafter, also simply referred to as "hybrid amorphous resin").

The styrene-acrylic resin portion has high compatibility with an amorphous vinyl resin and the amorphous polyester resin can be uniformly dispersed in the toner base particle. In the case that the toner base particle has a core-shell structure and the shell layer contains the amorphous polyester resin, aggregation on the surface of the core particle containing an amorphous vinyl resin tends to occur and the whole surface tends to be covered.

In the present embodiment, "an amorphous polyester resin is modified with a styrene-acrylic resin" refers to a state in which an amorphous polyester resin segment and a styrene-acrylic resin segment chemically bond to each other. An amorphous polyester resin segment refers to a resin portion derived from an amorphous polyester resin, that is, a molecular chain having the same chemical structure as the amorphous polyester resin, in a hybrid resin. A styrene-acrylic resin segment refers to a resin portion derived from a styrene-acrylic resin, that is, a molecular chain having the same chemical structure as the styrene-acrylic resin, in a hybrid resin. The styrene-acrylic resin can be produced in the same manner by using the materials described above for the hybrid crystalline resin.

The number average molecular weight of the hybrid amorphous polyester resin is preferably 2,000 to 10,000 from the viewpoint of fixability.

The content of the amorphous polyester resin in the toner base particle is preferably 1 to 50 mass % from the viewpoint of fixability and environmental stability of charging.

[Coloring Agent]

For the coloring agent, a known inorganic or organic coloring agent as a coloring agent for a color toner is used. Examples of the coloring agent include carbon black, magnetic materials, pigments, and dyes. One coloring agent or more than one coloring agent may be used.

Examples of the carbon black include channel black, furnace black, acetylene black, thermal black, and lamp black. Examples of the magnetic material include ferromagnetic metals such as iron, nickel, and cobalt, alloys containing these metals, and compounds of ferromagnetic metals such as ferrite and magnetite.

Examples of the pigment include C. I. Pigment Reds 2, 3, 5, 7, 15, 16, 48:1, 48:3, 53:1, 57:1, 81:4, 122, 123, 139, 144, 149, 166, 177, 178, 208, 209, 222, 238, and 269; C. I. Pigment Oranges 31 and 43; C. I. Pigment Yellows 3, 9, 14, 17, 35, 36, 65, 74, 83, 93, 94, 98, 110, 111, 138, 139, 153, 155, 180, 181, and 185; C. I. Pigment Green 7; C. I. Pigment Blues 15:3, 15:4, and 60; and phthalocyanine pigments whose center metal is zinc, titanium, magnesium, or the like.

Examples of the dye include C. I. Solvent Reds 1, 3, 14, 17, 18, 22, 23, 49, 51, 52, 58, 63, 87, 111, 122, 127, 128, 131, 145, 146, 149, 150, 151, 152, 153, 154, 155, 156, 157, 158, 176, and 179; pyrazolotriazole azo dyes; pyrazolotriazole azomethine dyes; pyrazolone azo dyes; and pyrazolone azomethine dyes; C. I. Solvent Yellows 19, 44, 77, 79, 81, 82, 93, 98, 103, 104, 112, and 162; and C. I. Solvent Blues 25, 36, 60, 70, 93, and 95.

[Release Agent]

Examples of the release agent (wax) include hydrocarbon waxes and ester waxes. Examples of the hydrocarbon wax include low-molecular weight polyethylene wax, low-molecular weight polypropylene wax, Fischer-Tropsch waxes, microcrystalline waxes, and paraffin waxes. Examples of the ester wax include carnauba waxes, pentaerythritol behenate, behenyl behenate, and behenyl citrate. One release agent or more than one release agent may be used.

[Charging-Controlling Agent]

Examples of the charging-controlling agent include nigrosine dyes; metal salts of naphthenic acids or higher fatty acids; alkoxylated amines; quaternary ammonium salt compounds; azo-metal complexes; and metal salicylate and metal complexes thereof. One charging-controlling agent or more than one charging-controlling agent may be used.

[Surfactant]

Examples of the surfactant include anionic surfactants such as sulfate ester salts, sulfonate salts, and phosphate esters; cationic surfactants such as amine salts and quaternary ammonium salts; and nonionic surfactants such as polyethylene glycol-type surfactants, alkylphenol-ethylene oxide adducts, and polyalcohols. One surfactant or more than one surfactant may be used.

Specific examples of the anionic surfactant include sodium dodecylbenzenesulfonate, sodium dodecyl sulfate, sodium alkylnaphthalenesulfonates, and sodium dialkyl sulfosuccinates. Specific examples of the cationic surfactant include alkylbenzenedimethylammonium chlorides, alkyltrimethylammonium chlorides, and distearylammonium chloride. Examples of the nonionic surfactant include polyoxyethylene alkyl ethers, glycerin fatty acid esters, sorbitan fatty acid esters, polyoxyethylenesorbitan fatty acid esters, and polyoxyethylene fatty acid esters.

[Structure of Toner Particle]

The structure of the toner particle according to the present embodiment may be a monolayer structure consisting only of the above-described toner particle, or a multilayer structure such as a core-shell structure which includes a core particle of the above-described toner particle and a shell layer covering the core particle and the surface thereof. The shell layer need not cover the whole surface of the core particle, and the core particle may be partially exposed. The cross section of the core-shell structure can be examined, for example, by using known means for observation such as a transmission electron microscope (TEM) and a scanning probe microscope (SPM).

In the case of the core-shell structure, the core particle and the shell layer can be different in properties such as glass transition temperature, melting point, and hardness, and toner particles can be designed in accordance with intended use. For example, a shell layer can be formed by aggregating and fusing a resin having a relatively high glass transition temperature on the surface of the core particle containing a binder resin, a coloring agent, a release agent, etc., and having a relatively low glass transition temperature. As described above, an amorphous polyester resin can be used for the shell layer, and especially, an amorphous polyester resin modified with a styrene-acrylic resin can be preferably used.

[Melting Point]

The toner particle according to the present embodiment preferably has a melting point of 60 to 90° C., and more preferably 65 to 80° C. If the melting point is within the range, sufficient low-temperature fixability and high-temperature storability can be achieved simultaneously. In addition, the thermal resistance (thermal strength) of the toner can be maintained at a satisfactory level, and sufficient high-temperature storability can be obtained. The melting point can be measured in the same manner as the crystalline polyester resin.

[Particle Size of Toner Particle]

The volume-based median diameter of the toner particle according to the present embodiment is preferably 3 to 8 μm, and more preferably 5 to 8 μm. If the volume-based median diameter is within the range, high-resolution dots at approximately 1,200 dpi can be accurately reproduced. The volume-based median diameter can be controlled through the concentration of an aggregating agent used in production, the amount of an organic solvent added, fusion time, the composition of the binder resin, etc.

The volume-based median diameter can be measured by using a measuring apparatus including a Multisizer 3 (from Beckman Coulter, Inc.) to which a computer system with installed data analysis software Software v.3.51 is connected. Specifically, 0.02 g of a sample (toner) is added to 20 mL of a surfactant solution (e.g., a surfactant solution obtained by diluting a neutral detergent containing a surfactant component 10-fold with pure water for the purpose of dispersing a toner particle) and conditioned, and the resultant solution is then subjected to ultrasonic dispersing for 1 minute to prepare a dispersion of a toner. The dispersion of a toner is injected with a pipet into a beaker containing an ISOTON II (from Beckman Coulter, Inc.) in a sample stand until the concentration displayed on the measuring apparatus reaches 8%. This concentration provides a reproducible measurement.

Then, the number of counts for particles to be measured and the aperture diameter for the measuring apparatus are set to 25,000 and 100 μm, respectively, and a measurement range of 2 to 60 μm is divided into 256 portions to calculate a frequency value for each portion, and the particle size at 50% from the largest cumulative volume percentage is determined as the volume-based median diameter.

[Average Circularity of Toner Particle]

In the toner according to the present embodiment, the average circularity of the toner particle is preferably 0.930 to 1.000, and more preferably 0.950 to 0.995. If the average circularity is within the range, the toner particle can be prevented from breaking, and a friction-charging member can be prevented from being stained to stabilize the charging characteristics of the toner. In addition, an image formed with the toner has a high image quality.

The average circularity can be measured as follows. A dispersion of a toner is prepared in the same manner as in the case of the measurement of a median diameter. With an FPIA-2100, an FPIA-3000, (both from Sysmex Corporation, "FPIA" is a registered trademark of this corporation), or the like, an image of the dispersion of a toner is taken in HPF (high-power field) mode with a proper concentration range of 3,000 to 10,000 as HPF detection number, and the circularity of each toner particle is calculated by using equation y. The circularities of the toner particles are added together, and the sum of the circularities is divided by the number of the toner particles to calculate the average circularity. If the HPF detection number is within the proper concentration range, sufficient reproducibility can be obtained. In equation y, L1 represents circumference (μm) of a circle having the same projected area as a particle image, and L2 represents perimeter (μm) of a projected image of a particle.

$$\text{Circularity}=L1/L2 \qquad \text{(Equation y)}$$

[External Additive]

The toner particle according to the present embodiment may contain, for example, the toner base particle and an external additive present on the surface of the toner base particle. It is preferable that the toner particle contain an external additive from the viewpoint of controlling flowability, charging characteristics, etc., of the toner particle. One external additive or more than one external additive may be used. Examples of the external additive include a silica particle, a titania particle, an alumina particle, a zirconia particle, a zinc oxide particle, a chromium oxide particle, a cerium oxide particle, an antimony oxide particle, a tungsten oxide particle, a tin oxide particle, a tellurium oxide particle, a manganese oxide particle, and a boron oxide particle.

The external additive preferably contains a silica particle formed through a sol-gel method. Silica particles formed through a sol-gel method have a feature of a narrow particle size distribution, and thus are preferred from the viewpoint of suppressing variation of the attaching strength of the external additive to the toner base particle.

The number average primary particle size of the silica particle is preferably 70 to 200 nm. Silica particles having a number average primary particle size within the range are larger than other external additives. Accordingly, such a silica particle serves as a spacer in a two-component developer, and is preferred from the viewpoint of preventing other smaller external additives from being buried in the toner base particle while a two-component developer is stirred in a developing device. In addition, such a silica particle is preferred also from the viewpoint of preventing the toner base particle from fusing together.

The number average primary particle size of the external additive can be determined, for example, through image processing for an image taken with a transmission electron microscope, and can be adjusted, for example, through classification or mixing with a classified product.

The surface of the external additive preferably has been subjected to hydrophobic treatment. For the hydrophobic treatment, a known surface treating agent is used. One surface treating agent or more than one surface treating agent may be used, and examples thereof include silane coupling agents, silicone oils, titanate coupling agents, aluminate coupling agents, fatty acids, metal salts of fatty acids, esters thereof, and rosin acids.

Examples of the silane coupling agent include dimethyldimethoxysilane, hexamethyldisilazane (HMDS), methyltrimethoxysilane, isobutyltrimethoxysilane, and decyltrimethoxysilane. Examples of the silicone oil include cyclic compounds and linear or branched organosiloxanes, and more specifically include organosiloxane oligomers, octamethylcyclotetrasiloxane, decamethylcyclopentasiloxane, tetramethylcyclotetrasiloxane, and tetravinyltetramethylcyclotetrasiloxane.

Examples of the silicone oil include silicone oils which are highly reactive and at least one end of which is modified by introducing a modifying group to a side chain, one end, both ends, one end of a side chain, both ends of a side chain, or the like. One type of a modifying group or more than one type of modifying groups may be used, and examples of the modifying group include an alkoxy group, a carboxyl group, a carbinol group, a higher fatty acid modifying group, a phenol group, an epoxy group, a methacryl group, and an amino group.

The amount of the external additive to be added is preferably 0.1 to 10.0 mass %, and more preferably 1.0 to 3.0 mass % based on the total amount of the toner particle.

[Developer]

The toner is composed of the toner particle itself in the case of a one-component developer, and composed of the toner particle and a carrier particle in the case of a two-component developer. The content of the toner particle (toner concentration) in the two-component developer may be the same as that in common two-component developers, and for example, is 4.0 to 8.0 mass %.

The carrier particle is composed of a magnetic material. Examples of the carrier particle include a coated carrier particle including a core material particle consisting of the magnetic material and a coating layer covering the surface of the core material particle, and a resin-dispersed carrier particle including a fine particle of a magnetic material dispersed in a resin. The carrier particle is preferably the coated carrier particle from the viewpoint of preventing the carrier particle from attaching to a photoconductor.

The core material particle is composed of a magnetic material such as a substance which is strongly magnetized by a magnetic field in the direction of the magnetic field. One magnetic material or more than one magnetic material may be used, and examples thereof include ferromagnetic metals such as iron, nickel, and cobalt; alloys or compounds containing these metals; and alloys which exhibit ferromagnetism via heat treatment.

Examples of the ferromagnetic metal and compound containing it include iron, ferrites represented by formula (a), and magnetites represented by formula (b). M in formula (a) and formula (b) denotes one or more monovalent or divalent metals selected from the group consisting of Mn, Fe, Ni, Co, Cu, Mg, Zn, Cd, and Li.

$$MO{\cdot}Fe_2O_3 \qquad \text{Formula (a)}$$

$$MFe_2O_4 \qquad \text{Formula (b)}$$

Examples of the alloy or metal oxide which exhibits ferromagnetism via heat treatment include Heusler alloys such as manganese-copper-aluminum and manganese-copper-tin; and chromium dioxide.

The core material particle is preferably the ferrite. The reason is that impact force due to stirring in a developing device can be reduced because the specific gravity of the coated carrier particle is smaller than that of a metal constituting the core material particle.

One coating material or more than one coating material may be used. For the coating material, a known resin for covering a core material particle of a carrier particle may be used. The coating material is preferably a resin having a cycloalkyl group from the viewpoint of the lowering of the moisture adsorption of the carrier particle and the enhancement of the adhesion of the coating layer to the core material particle. Examples of the cycloalkyl group include a cyclohexyl group, a cyclopentyl group, a cyclopropyl group, a cyclobutyl group, a cycloheptyl group, a cyclooctyl group, a cyclononyl group, and a cyclodecyl group. Among them, a cyclohexyl group and a cyclopentyl group are preferred, and a cyclohexyl group is more preferred from the viewpoint of the adhesion of the coating layer to a ferrite particle.

The weight average molecular weight of the resin having a cycloalkyl group is, for example, 10,000 to 800,000, and more preferably 100,000 to 750,000. The content of the cycloalkyl group in the resin is, for example, 10 to 90 mass %. The content of the cycloalkyl group in the resin can be determined by using a known instrumental analysis method such as pyrolysis-gas chromatography/mass spectrometry (Py-GC/MS) and proton magnetic resonance spectroscopy ($^1$H-NMR).

The two-component developer can be produced by mixing the toner particle and the carrier particle in appropriate amounts. Examples of mixing apparatuses for the mixing include a Nauta mixer, and W-cone and V-shaped mixers.

The size and shape of the toner particle may be appropriately determined as long as the advantageous effects of the present embodiment can be obtained. For example, the volume average particle size of the toner particle is 3.0 to 8.0 μm, and the average circularity of the toner particle is 0.920 to 1.000.

Similarly, the size and shape of the carrier particle may be appropriately determined as long as the advantageous effects of the present embodiment can be obtained. The volume average particle size of the carrier particle is, for example, 15 to 100 μm. The volume average particle size of the carrier particle can be measured, for example, by using a wet method with the laser diffraction particle size distribution measuring apparatus "HELOS KA" (from Japan Laser Corporation). The volume average particle size of the carrier particle can be adjusted, for example, through a method of controlling the particle size of the core material particle via production conditions for the core material particle, classification of the carrier particle, or mixing with a classified product of a carrier particle.

As described above, the process for producing a toner according to the present embodiment includes: a first step of heating a dispersion containing an aqueous medium and a binder resin containing a crystalline resin to a temperature higher than or equal to a melting point of the crystalline resin in a production step for forming a toner base particle by aggregating and fusing a fine particle of the binder resin containing the crystalline resin in the presence of a metal ion; and a second step of maintaining the dispersion at temperature T (° C.) for 30 minutes or longer in a state where a pH of the dispersion is maintained at 5.5 or higher and 9.0 or lower, in which the temperature T satisfies the following expression, $Rc-25 \leq T \leq Rc-5$, where the Rc represents a recrystallization temperature (° C.) of the crystalline resin.

One of the features of the above process for producing a toner is that a toner having excellent low-temperature fixability and low density unevenness of images to be formed can be obtained, and the reason is presumably as follows.

As described above, in the present embodiment a toner base particle is produced by an emulsion aggregation method in which fine particles of a binder resin is aggregated in the presence of a metal ion as an aggregating agent. Because a dispersion containing the toner base particle is subjected to heat treatment under a particular heat treatment scheme, domains of a crystalline resin are deemed to be finely dispersed in the toner base particle without being present in the vicinity of the surface of the toner base particle. In addition, because a pH of the dispersion is maintained at 5.5 or higher during the heat treatment, an acid group of the binder resin does not dissociate. Accordingly, a crosslinking amount by the metal ion, which aggregates the fine particles of the binder resin, is not lowered, and as a result increase in a domain diameter of the crystalline resin and/or bleeding of the crystalline resin into the vicinity of the surface of the toner base particle is presumably suppressed. Further, since the pH of the dispersion is maintained at 9.0 or lower during the heat treatment, it is considered that the crosslinking amount by the metal ion does not increase excessively and the fine particles of the binder resin do not aggregate too tightly, resulting in suppressed deterioration of low-temperature fixability.

Thus, in a toner produced by the production process of the present embodiment, a domain diameter of a crystalline resin does not increase and a finely dispersed state of the crystalline resin domains in the toner base particle is maintained. Accordingly, deterioration of surface resistance, charging characteristics, and so forth of a toner are presumably suppressed, achieving low-temperature fixability of a toner and suppressed density unevenness of images.

T satisfying $Rc-25 \leq T \leq Rc-10$ is more effective from the viewpoint of enhancing low-temperature fixability of a toner and suppressing density unevenness of images.

Further including a step of cooling the dispersion having been heated to a temperature higher than Rc to a temperature lower than Rc−25° C. is more effective from the viewpoint of suppressing density unevenness of images.

Further including a step of cooling the dispersion having been heated to a temperature higher than Rc to a temperature lower than Rc at a temperature-lowering rate of 1° C./min or higher is more effective from the viewpoint of enhancing low-temperature fixability.

The use of a crystalline polyester resin as the crystalline resin is more effective from the viewpoint of enhancing low-temperature fixability.

The toner is applied to common electrophotographic image forming methods, and is used for development of electrostatic latent images.

As evident from the above description, a process for producing a toner according to the present embodiment can accurately control a presence state and a domain diameter of a crystalline resin in a toner even during heat treatment, and consequently both low-temperature fixability and suppressed density unevenness of images can be achieved.

EXAMPLES

Hereinafter, the present invention will be described more specifically with reference to Examples and Comparative Examples, but the present invention is never limited to Examples below.

[Synthesis of Crystalline Polyester Resin and Preparation of Dispersion Thereof]

(Synthesis of Crystalline Polyester Resin 1)

The following raw material monomers of an addition polymerization resin (styrene-acrylic resin: StAc) segment, including bireactive monomers, and radical polymerization initiator were placed in a dropping funnel.

| | |
|---|---|
| Styrene | 36.0 parts by weight |
| n-Butyl acrylate | 13.0 parts by weight |
| Acrylic acid | 2.0 parts by weight |
| Polymerization initiator (di-t-butyl peroxide) | 7.0 parts by weight |

The following raw material monomers of a polycondensation resin (crystalline polyester resin: CPEs) segment were placed in a four-necked flask equipped with a nitrogen inlet tube, a dehydration tube, a stirrer, and a thermocouple, and heated to 170° C. to dissolve.

| | |
|---|---|
| Tetradecanedioic acid | 440 parts by weight |
| 1,4-Butanediol | 153 parts by weight |

Subsequently, the raw materials of an addition polymerization resin (StAc) were added dropwise to the dissolved monomer solution under stirring over 90 minutes, and the resultant solution was aged for 60 minutes and then unreacted addition-polymerizable monomers were removed under reduced pressure (8 kPa). The amount of the removed monomers was only a trace amount relative to the raw material monomer of the resin. Thereafter, 0.8 part by weight of $Ti(OBu)_4$ as an esterification catalyst was added thereto, and the temperature was elevated to 235° C., and reaction was performed under atmospheric pressure (101.3 kPa) for 5 hours and then under reduced pressure (8 kPa) for 1 hour.

The resultant mixture was then cooled to 200° C. and subsequently allowed to react under reduced pressure (20 kPa) for 1 hour to afford crystalline polyester resin 1. The weight average molecular weight, melting point, and recrystallization temperature (Rc) of crystalline polyester resin 1 obtained were 24,500, 75.5° C., and 70.6° C., respectively.

(Preparation of Crystalline Polyester Resin Particle Dispersion 1)

Crystalline polyester resin 1 in an amount of 100 parts by weight was dissolved in 400 parts by weight of ethyl acetate (from KANTO CHEMICAL CO., INC.), and the resultant solution was mixed with 638 parts by weight of a 0.26 mass % sodium lauryl sulfate solution prepared in advance. The resultant mixed solution was subjected to ultrasonic dispersing with the ultrasonic homogenizer US-150T (from NISSEI Corporation) at 300 μA of V-LEVEL under stirring for 30 minutes. Thereafter, the resultant dispersion was warmed to 40° C., and at the temperature the ethyl acetate was completely removed with the diaphragm vacuum pump V-700 (from BUCHI Ladotechnik AG) under reduced pressure and stirring for 3 hours to prepare crystalline polyester resin particle dispersion 1. The crystalline polyester resin particle in the dispersion had a volume-based median diameter of 160 nm.

(Synthesis of Crystalline Polyester Resin 2)

In a reaction vessel equipped with a stirrer, a thermometer, a condenser, and a nitrogen inlet tube, 315 parts by weight of tetradecanedioic acid and 252 parts by weight of 1,4-butanediol were placed. The inside of the reaction vessel was purged with dry nitrogen gas, and then 0.1 part by weight of titanium tetrabutoxide was added thereto, and polymerization reaction was performed under stirring in a nitrogen gas flow at 180° C. for 8 hours. Further, 0.2 part by weight of titanium tetrabutoxide was added thereto, and the temperature was elevated to 220° C., and polymerization reaction was performed under stirring for 6 hours. Thereafter, the pressure in the reaction vessel was reduced to 10 mmHg (13.3 hPa), and reaction was performed under reduced pressure to obtain crystalline polyester resin 2. The weight average molecular weight, melting point, and recrystallization temperature (Rc) of crystalline polyester resin 2 obtained were 22,000, 75.0° C., and 70.8° C., respectively.

(Preparation of Crystalline Polyester Resin Particle Dispersion 2)

Crystalline polyester resin 2 in an amount of 100 parts by weight was dissolved in 400 parts by weight of ethyl acetate (from KANTO CHEMICAL CO., INC.), and the resultant solution was mixed with 638 parts by weight of a 0.26 mass % sodium lauryl sulfate solution prepared in advance. The mixed solution was subjected to ultrasonic dispersing with the ultrasonic homogenizer US-150T (from NISSEI Corporation) at 300 μA of V-LEVEL under stirring for 30 minutes. Thereafter, the resultant dispersion was warmed to 40° C., and at the temperature the ethyl acetate was completely removed with the diaphragm vacuum pump V-700 (from BUCHI Ladotechnik AG) under reduced pressure and stirring for 3 hours to prepare crystalline polyester resin particle dispersion 2. The crystalline polyester resin particle in the dispersion had a volume-based median diameter of 160 nm.

(Synthesis of Crystalline Polyester Resin 3)

In a reaction vessel equipped with a stirring apparatus, a nitrogen inlet tube, a temperature sensor, and a rectifying column, 200 parts by weight of dodecanedioic acid and 102 parts by weight of 1,6-hexanediol were fed, and the temperature of the reaction system was elevated to 190° C. over 1 hour. After confirmation that the reaction system was uniformly stirred, 0.3 part by weight of $Ti(OBu)_4$ as a catalyst was added thereto and the temperature of the reaction system was further elevated from 190° C. to 240° C. over 6 hours while evaporating and removing generated water, and dehydration condensation reaction was continuously performed for 6 hours with the temperature maintained at 240° C. for polymerization to obtain crystalline polyester resin 3. The weight average molecular weight, melting point, and recrystallization temperature (Rc) of crystalline polyester resin 3 obtained were 14,500, 70° C., and 65.8° C., respectively.

(Preparation of Crystalline Polyester Resin Particle Dispersion 3)

Crystalline polyester resin 3 in an amount of 100 parts by weight was dissolved in 400 parts by weight of ethyl acetate (from KANTO CHEMICAL CO., INC.), and the resultant solution was mixed with 638 parts by weight of a 0.26 mass % sodium lauryl sulfate solution prepared in advance. The mixed solution was subjected to ultrasonic dispersing with the ultrasonic homogenizer US-150T (from NISSEI Corporation) at 300 μA of V-LEVEL under stirring for 30 minutes. Thereafter, the resultant dispersion was warmed to 40° C., and at the temperature the ethyl acetate was completely removed with the diaphragm vacuum pump V-700 (from BUCHI Ladotechnik AG) under reduced pressure and stirring for 3 hours to prepare crystalline polyester resin particle dispersion 3. The crystalline polyester resin particle in the dispersion had a volume-based median diameter of 160 nm.

(Preparation of Coloring Agent Particle Dispersion)

To a solution prepared by adding 90 parts by weight of sodium dodecyl sulfate to 1,600 parts by weight of deionized water, 420 parts by weight of copper phthalocyanine (C. I. Pigment Blue 15:3) was gradually added under stirring. The resultant solution was dispersed with the stirring apparatus CLEARMIX (from M Technique Co., Ltd., "CLEARMIX" is a registered trade name) to prepare a coloring agent particle dispersion. The coloring agent particle in the dispersion had a volume-based median diameter of 110 nm.

[Preparation of Amorphous Vinyl Resin Particle Dispersion for Core]

(First Stage of Polymerization)

In a 5 L reaction vessel equipped with a stirring apparatus, a temperature sensor, a condenser, and a nitrogen inlet tube, 8 parts by weight of sodium dodecyl sulfate and 3,000 parts by weight of deionized water were fed, and the internal temperature was elevated to 80° C. under stirring at a stirring rate of 230 rpm in a nitrogen gas flow. After the temperature elevation, a solution prepared by dissolving 10 parts by weight of potassium persulfate in 200 parts by weight of deionized water was added thereto, and the temperature of the solution was again set to 80° C. and a mixed solution of the following monomers was added dropwise thereto over 1 hour.

| | |
|---|---|
| Styrene | 480.0 parts by weight |
| n-Butyl acrylate | 250.0 parts by weight |
| Methacrylic acid | 68.0 parts by weight |

After the dropwise addition of the mixed solution, the resultant solution was heated and stirred at 80° C. for 2 hours to polymerize the monomers, and thus an amorphous vinyl resin particle dispersion for a core was prepared.

(Second Stage of Polymerization)

In a 5 L reaction vessel equipped with a stirring apparatus, a temperature sensor, a condenser, and a nitrogen inlet tube, a solution prepared by dissolving 7 parts by weight of sodium polyoxyethylene (2) dodecyl ether sulfate in 3,000 parts by weight of deionized water was fed, and heated to 98° C. After the heating, the amorphous vinyl resin particle dispersion prepared in the first stage of polymerization in an amount of 80 parts by weight in terms of solids content, and a mixed solution prepared by dissolving the following monomers, chain transfer agent, and release agent at 90° C. were added thereto.

| | |
|---|---|
| Styrene (St) | 285.0 parts by weight |
| n-Butyl acrylate (BA) | 95.0 parts by weight |
| Methacrylic acid (MAA) | 20.0 parts by weight |
| n-Octyl 3-mercaptopropionate (chain transfer agent) | 1.5 parts by weight |
| Behenyl behenate (release agent, melting point: 73° C.) | 190.0 parts by weight |

Mixing and dispersing was carried out with a CLEARMIX (from M Technique Co., Ltd.), a mechanical disperser having a circulation path, for 1 hour to prepare a dispersion containing an emulsified particle (oil droplet). To this dispersion, a solution of a polymerization initiator prepared by dissolving 6 parts by weight of potassium persulfate in 200 parts by weight of deionized water was added, and this system was heated and stirred at 84° C. over 1 hour for polymerization to prepare an amorphous vinyl resin particle dispersion.

(Third Stage of Polymerization)

To the amorphous vinyl resin particle dispersion obtained in the second stage of polymerization, 400 parts by weight of deionized water was further added and thoroughly mixed, and then a solution prepared by dissolving 11 parts by weight of potassium persulfate in 400 parts by weight of deionized water was added thereto. Furthermore, a mixed solution of the following monomers and chain transfer agent was added dropwise thereto under a temperature condition of 82° C. over 1 hour.

| | |
|---|---|
| Styrene (St) | 454.8 parts by weight |
| 2-Ethylhexyl acrylate (2EHA) | 143.2 parts by weight |
| Methacrylic acid (MAA) | 52.0 parts by weight |
| n-Octyl 3-mercaptopropionate | 8.0 parts by weight |

After the dropwise addition, the resultant solution was heated and stirred over 2 hours for polymerization, and then cooled to 28° C. to prepare an amorphous vinyl resin dispersion for a core.

[Amorphous Polyester Resin for Shell Layer]

A mixed solution of the following monomers of a styrene-acrylic resin, monomer having a substituent capable of reacting with both of an amorphous polyester resin and the styrene-acrylic resin, and polymerization initiator was placed in a dropping funnel.

| | |
|---|---|
| Styrene | 80.0 parts by weight |
| n-Butyl acrylate | 20.0 parts by weight |
| Acrylic acid | 10.0 parts by weight |
| Di-t-butyl peroxide (polymerization initiator) | 16.0 parts by weight |

The following monomers of an amorphous polyester resin were placed in a four-necked flask equipped with a nitrogen inlet tube, a dehydration tube, a stirrer, and a thermocouple, and heated to 170° C. to dissolve.

| | |
|---|---|
| Bisphenol A - propylene oxide adduct (1:2) | 285.7 parts by weight |
| Terephthalic acid | 66.9 parts by weight |
| Fumaric acid | 47.4 parts by weight |

The mixed solution placed in the dropping funnel was added dropwise into the four-necked flask over 90 minutes under stirring, and the resultant solution was aged for 60 minutes, and unreacted monomers were then removed under reduced pressure (8 kPa). Thereafter, 0.4 part by weight of $Ti(OBu)_4$ as an esterification catalyst was added thereto, and the temperature was elevated to 235° C., and reaction was performed under atmospheric pressure (101.3 kPa) for 5 hours and then under reduced pressure (8 kPa) for 1 hour. The resultant solution was then cooled to 200° C. and allowed to react under reduced pressure (20 kPa) for 1 hour, and subsequently the solvent was removed to afford an amorphous polyester resin for a shell layer modified with a styrene-acrylic resin. The weight average molecular weight and the glass transition temperature of the amorphous polyester resin for a shell layer obtained were 25,000 and 60° C., respectively. The weight average molecular weight was measured in the same manner as in the case of the above-described crystalline polyester resin, and the glass transition temperature was measured in the same manner as in the case of the amorphous vinyl resin.

[Preparation of Amorphous Polyester Resin Particle Dispersion for Shell Layer]

The amorphous polyester resin for a shell layer in an amount of 100 parts by weight was dissolved in 400 parts by weight of ethyl acetate (from KANTO CHEMICAL CO., INC.), and the resultant solution was mixed with 638 parts by weight of a 0.26 mass % sodium lauryl sulfate solution prepared in advance. The mixed solution was subjected to ultrasonic dispersing with the ultrasonic homogenizer US-150T (from NISSEI Corporation) at 300 μA of V-LEVEL under stirring for 30 minutes. Thereafter, the resultant dispersion was warmed to 40° C., and at the temperature the ethyl acetate was completely removed with the diaphragm vacuum pump V-700 (from BUCHI Ladotechnik AG) under reduced pressure and stirring for 3 hours to prepare an amorphous polyester resin particle dispersion for a shell layer having a solids content of 13.5 mass %. The amorphous polyester resin particle in the dispersion had a volume-based median diameter of 160 nm.

Example 1: Production of Toner 1

Into a reaction vessel equipped with a stirring apparatus, a temperature sensor, and a condenser, 285 parts by weight (in terms of solids content) of the amorphous vinyl resin particle dispersion for a core, 40 parts by weight (in terms of solids content) of crystalline polyester resin particle dispersion 1, sodium dodecyl diphenyl ether disulfonate at a ratio of 1 mass % to the resin (in terms of solids content), and 2,000 parts by weight of deionized water were fed. At room temperature (25° C.), a 5 mol/L aqueous solution of sodium hydroxide was added thereto to adjust the pH to 10. Further, 30 parts by weight (in terms of solids content) of the coloring agent particle dispersion was added thereto and a solution prepared by dissolving 60 parts by weight of magnesium chloride in 60 parts by weight of deionized water was added thereto under stirring at 30° C. over 10 minutes. After the resultant solution was left to stand for 3 minutes, the temperature was elevated to 80° C. over 60 minutes. After the temperature reached 80° C., the stirring rate was adjusted so that the growth rate of the particle size became 0.01 μm/min, and the particle was allowed to grow until the volume-based median diameter measured with a Coulter Multisizer 3 (from Beckman Coulter, Inc.) reached 6.0 μm.

Subsequently, 37 parts by weight (in terms of solids content) of the amorphous polyester resin particle dispersion for a shell was added thereto over 30 minutes, and at the timing when the supernatant of the dispersion became clear, an aqueous solution prepared by dissolving 190 parts by weight of sodium chloride in 760 parts by weight of deionized water was added thereto to terminate the growth of the particle. The temperature was then elevated to 80° C. and at the temperature stirring was performed to allow the fusion of the particle to progress until the average circularity of the toner base particle reached 0.970. Then, the dispersion of the toner base particle obtained was subjected to the following cooling/heat treatment steps (see scheme 1 of Table 1).

1) The temperature of the dispersion was lowered to 65° C. (pre-heat treatment step temperature) with the temperature-lowering rate (cooling rate) at Rc adjusted to 1.0° C./min. 2) Then, a 5 mol/L aqueous solution of sodium hydroxide was added into the dispersion to adjust the pH of the dispersion to 7. 3) After that, the dispersion was cooled from 65° C. (heat treatment step initiation temperature) to 61° C. (heat treatment step termination temperature) over 30 minutes (the second step). Finally, the dispersion obtained was cooled to 30° C.

Subsequently, solid-liquid separation was performed, and the dehydrated toner cake was dispersed in deionized water again, and washed through three cycles of solid-liquid separation. After washing, the resultant toner cake was dried at 40° C. for 24 hours to afford a toner particle. To 100 parts by weight of the toner particle obtained, 0.6 part by weight of a hydrophobic silica particle (number average primary particle size: 12 nm, degree of hydrophobicity: 68), 1.0 part by weight of a hydrophobic titanium oxide particle (number average primary particle size: 20 nm, degree of hydrophobicity: 63), and 1.0 part by weight of sol-gel silica (number average primary particle size=110 nm) were added, and the resultant composition was mixed by using a Henschel mixer (from NIPPON COKE & ENGINEERING Co., LTD.) with a peripheral speed of the rotating blade of 35 mm/sec at 32° C. for 20 minutes. After mixing, coarse particles were removed with a sieve having a mesh size of 45 μm to obtain toner 1.

Examples 2 to 6: Production of Toners 2 to 6

Toners 2 to 6 were produced in the same manner as in Example 1 except that the heat treatment step was changed to schemes 2 to 6 listed in Table 1, respectively.

Example 7: Production of Toner 7

Toner 7 was produced in the same manner as in Example 1 except that the heat treatment step was changed to scheme 6 listed in Table 1 and the cooling rate at Rc was changed to 2° C./min.

Example 8: Production of Toner 8

Toner 8 was produced in the same manner as in Example 1 except that the heat treatment step was changed to scheme 6 listed in Table 1 and the cooling rate at Rc was changed to 5° C./min.

Example 9: Production of Toner 9

Toner 9 was produced in the same manner as in Example 1 except that the heat treatment step was changed to scheme 6 listed in Table 1, the cooling rate at Rc was changed to 0.5° C./min, and the pH of the dispersion in the heat treatment step was changed to 7.

Example 10: Production of Toner 10

Toner 10 was produced in the same manner as in Example 1 except that the heat treatment step was changed to scheme 6 listed in Table 1, the cooling rate at Rc was changed to 2° C./min, and the pH of the dispersion in the heat treatment step was changed to 8.

Example 11: Production of Toner 11

Toner 11 was produced in the same manner as in Example 1 except that the heat treatment step was changed to scheme 6 listed in Table 1, the cooling rate at Rc was changed to 2° C./min, and the pH of the dispersion in the heat treatment step was changed to 9.

Example 12: Production of Toner 12

Toner 12 was produced in the same manner as in Example 1 except that the heat treatment step was changed to scheme 6 listed in Table 1, the cooling rate at Rc was changed to 2° C./min, and the pH of the dispersion in the heat treatment step was changed to 6.

Example 13: Production of Toner 13

Toner 13 was produced in the same manner as in Example 1 except that the heat treatment step was changed to scheme 6 listed in Table 1, the cooling rate at Rc was changed to 2° C./min, and the pH of the dispersion in the heat treatment step was changed to 5.5.

Examples 14 to 16: Production of Toners 14 to 16

Toners 14 to 16 were produced in the same manner as in Example 1 except that the heat treatment step was changed to schemes 7 to 9 listed in Table 1, respectively, and the cooling rate at Rc was changed to 2° C./min.

Example 17: Production of Toner 17

Toner 17 was produced in the same manner as in Example 1 except that the heat treatment step was changed to scheme 6 listed in Table 1, the cooling rate at Rc was changed to 2° C./min, and crystalline resin 1 was changed to crystalline resin 2.

Example 18: Production of Toner 18

Toner 18 was produced in the same manner as in Example 1 except that the heat treatment step was changed to scheme 10 listed in Table 1, the cooling rate at Rc was changed to 2° C./min, and crystalline resin 1 was changed to crystalline resin 2.

Example 19: Production of Toner 19

Toner 19 was produced in the same manner as in Example 1 except that the heat treatment step was changed to scheme 11 listed in Table 1, the cooling rate at Rc was changed to 2° C./min, and crystalline resin 1 was changed to crystalline resin 3.

Example 20: Production of Toner 20

Toner 20 was produced in the same manner as in Example 1 except that the heat treatment step was changed to scheme 12 listed in Table 1, the cooling rate at Rc was changed to 2° C./min, and crystalline resin 1 was changed to crystalline resin 3.

Comparative Example 1: Production of Toner 21

Toner 21 was produced in the same manner as in Example 1 except that the heat treatment step was changed to scheme 6 listed in Table 1, the cooling rate at Rc was changed to 2° C./min, and the pH of the dispersion in the heat treatment step was changed to 10.0.

Comparative Example 2: Production of Toner 22

Toner 22 was produced in the same manner as in Comparative Example 1 except that the pH of the dispersion in the heat treatment step was changed to 4.0.

Comparative Example 3: Production of Toner 23

Toner 23 was produced in the same manner as in Example 1 except that the heat treatment step was changed to scheme 13 listed in Table 1 and the cooling rate at Rc was changed to 2° C./min.

Comparative Example 4: Production of Toner 24

Toner 24 was produced in the same manner as in Comparative Example 3 except that the heat treatment step was changed to scheme 14 listed in Table 1.

Comparative Example 5: Production of Toner 25

In the process for producing toner 1, a dispersion of a toner base particle was cooled without being subjected to a heat treatment step. Solid-liquid separation was then performed, and the dehydrated toner cake was dispersed in deionized water again, and washed through three cycles of solid-liquid separation, and dried at 40° C. for 24 hours. The toner base particle obtained was left to stand in an environment of 60° C. and 50% RH for 60 minutes. To 100 parts by weight of the toner base particle obtained, 0.6 part by weight of a hydrophobic silica particle (number average primary particle size: 12 nm, degree of hydrophobicity: 68), 1.0 part by weight of a hydrophobic titanium oxide particle (number average primary particle size: 20 nm, degree of hydrophobicity: 63), and 1.0 part by weight of sol-gel silica (number average primary particle size=110 nm) were added, and the resultant composition was mixed by using a Henschel mixer (from NIPPON COKE & ENGINEERING Co., LTD.) with a peripheral speed of the rotating blade of 35 mm/sec at 32° C. for 20 minutes. After mixing, coarse particles were removed with a sieve having a mesh size of 45 μm to obtain toner 25.

Comparative Example 6: Production of Toner 26

| | |
|---|---|
| Styrene (St) | 50.0 parts by weight |
| n-Butyl acrylate (BA) | 16.7 parts by weight |
| Methacrylic acid (MAA) | 3.5 parts by weight |
| Behenyl behenate (release agent, melting point: 73° C.) | 7.0 parts by weight |
| Crystalline polyester resin 1 | 8.0 parts by weight |

The above raw materials were mixed together, and a 15 mm ceramic bead was added thereto, and the resultant mixture was dispersed with an attritor (from NIPPON COKE & ENGINEERING Co., LTD.) for 2 hours to obtain a polymerizable monomer composition. Subsequently, 800 parts of deionized water and 15.5 parts of tricalcium phosphate were added into a container equipped with the high-speed stirring apparatus TK-homomixer (from Tokushu Kika Kogyo Co., Ltd.), and the rotational speed was adjusted to 15,000 rpm and the temperature was elevated to 70° C. to obtain an aqueous dispersion medium. To the above polymerizable monomer composition, 4.0 parts of t-butyl peroxypivalate as a polymerization initiator was added, and the resultant composition was added to the aqueous dispersion medium. Dispersing was performed for granulation by using the high-speed stirring apparatus for 3 minutes, with the rotational speed maintained at 15,000 rpm. Thereafter, the high-speed stirring apparatus was replaced with a stirring apparatus having a propeller stirring blade, and polymerization was performed under stirring at 150 rpm for 8.0 hours with the temperature maintained at 70° C., and the temperature was elevated to 80° C. and heating was performed for 4 hours. Heat treatment was then performed by using the same scheme for toner 7.

Subsequently, solid-liquid separation was performed, and the dehydrated toner cake was dispersed in deionized water again, and washed through three cycles of solid-liquid separation. After washing, the resultant toner cake was dried at 40° C. for 24 hours to afford a toner particle. To 100 parts by weight of the toner particle obtained, 0.6 part by weight of a hydrophobic silica particle (number average primary particle size: 12 nm, degree of hydrophobicity: 68), 1.0 part by weight of a hydrophobic titanium oxide particle (number average primary particle size: 20 nm, degree of hydrophobicity: 63), and 1.0 part by weight of sol-gel silica (number average primary particle size=110 nm) were added, and the resultant composition was mixed by using a Henschel mixer (from NIPPON COKE & ENGINEERING Co., LTD.) with a peripheral speed of a rotating blade of 35 mm/sec at 32° C. for 20 minutes. After mixing, coarse particles were removed with a sieve having a mesh size of 45 μm to obtain toner 26.

Table 1 shows heat treatment schemes for toners. In Table 1 below, "$T_0$" denotes a pre-heat treatment step temperature, "$T_s$" denotes an initiation temperature of the heat treatment step, and "$T_E$" denotes a termination temperature of the heat treatment step.

TABLE 1

| | | Heat treatment step | | | |
|---|---|---|---|---|---|
| Scheme (No.) | $T_0$ (° C.) | $T_S$ (° C.) | $T_E$ (° C.) | Scheme | Duration (min) |
| 1 | 65 | 65 | 61 | cooling | 30 |
| 2 | 65 | 65 | 61 | cooling | 60 |
| 3 | 60 | 65 | 65 | retention | 60 |
| 4 | 60 | 60 | 60 | retention | 60 |
| 5 | 45 | 60 | 60 | retention | 60 |
| 6 | 30 | 60 | 60 | retention | 60 |
| 7 | 30 | 55 | 55 | retention | 60 |
| 8 | 30 | 50 | 50 | retention | 60 |
| 9 | 30 | 46 | 46 | retention | 60 |
| 10 | 30 | 60 | 60 | retention | 120 |
| 11 | 30 | 55 | 55 | retention | 60 |
| 12 | 30 | 41 | 41 | retention | 60 |
| 13 | 30 | 70 | 70 | retention | 60 |
| 14 | 30 | 67 | 67 | retention | 60 |

[Evaluation for Toners]

(Evaluation on Low-Temperature Fixability (Under-Offset)]

The term "under-offset" refers to an image defect in which a toner peels off from a transfer material such as a recording sheet because melting of a toner layer by heat provided in passing through a fixing apparatus is insufficient. For evaluation on low-temperature fixability, each toner produced in the above was sequentially loaded on an image forming apparatus and an unfixed solid image (attached amount 11.3 g/m$^2$) was formed on mondi Color Copy (A4, 90 g/m$^2$; from Mondi plc) with the image forming apparatus in an environment of room temperature and normal humidity (20° C., 50% RH). Subsequently, the surface temperature of a pressure roller of the fixing apparatus was set to 100° C. and the images were fixed with the surface temperature of a heating roller changed at an interval of 2° C. within the range of 130 to 170° C. Then, the lower limit temperature for fixing (Tf) without under-offset was measured for the upper fixing belt.

Using the following evaluation criteria, low-temperature fixability was evaluated, and lower than 150° C. of a lower limit temperature for fixing was regarded as being acceptable. The results are shown in Tables 2 and 3.

(Density Unevenness of Images)

In an environment of room temperature and normal humidity (20° C., 55% RH), whole-surface solid images with original image density 1.30 were formed on 100 sheets of A4 wood-free paper (64 g/m$^2$). Then, an original with a set solid image having original reflection densities 1.30 at total five points of the four corners and the central part of the image was duplicated, and relative reflection densities of the output images based on white paper were measured at the five points. The difference ΔG between the maximum and minimum values of the image reflection densities measured as above at the five points was interpreted as density unevenness of images. Lower than 0.10 of density unevenness of images was regarded as being acceptable. The results are shown in Tables 2 and 3.

In Tables 2 and 3, "NPC" denotes an emulsion polymerization aggregation method (emulsion aggregation method), "SP" denotes a suspension polymerization method, "Tm" denotes a melting point of a crystalline resin, "temperature" of a dispersion indicates a temperature of the dispersion in the first step, "cooling rate" indicates a cooling rate in passing through Rc, "pH" indicates a pH of a dispersion at a pre-heat treatment temperature, "scheme" indicates a scheme for heat treatment, and "Tf" denotes a lower limit temperature for fixing.

TABLE 2

| | | | Crystalline resin | | | Dispersion | | | | | | |
|---|---|---|---|---|---|---|---|---|---|---|---|---|
| Example No. | Toner No. | Production process | No. | Tm (° C.) | Rc (° C.) | Temperature (° C.) | Cooling rate (° C./min) | Medium | pH (–) | Scheme No. | Tf (° C.) | ΔG (–) |
| 1 | 1 | NPC | 1 | 75.5 | 70.6 | 80 | 1 | aqueous | 7 | 1 | 144 | 0.09 |
| 2 | 2 | NPC | 1 | 75.5 | 70.6 | 80 | 1 | aqueous | 7 | 2 | 144 | 0.09 |
| 3 | 3 | NPC | 1 | 75.5 | 70.6 | 80 | 1 | aqueous | 7 | 3 | 144 | 0.08 |
| 4 | 4 | NPC | 1 | 75.5 | 70.6 | 80 | 1 | aqueous | 7 | 4 | 140 | 0.07 |
| 5 | 5 | NPC | 1 | 75.5 | 70.6 | 80 | 1 | aqueous | 7 | 5 | 140 | 0.06 |
| 6 | 6 | NPC | 1 | 75.5 | 70.6 | 80 | 1 | aqueous | 7 | 6 | 140 | 0.05 |
| 7 | 7 | NPC | 1 | 75.5 | 70.6 | 80 | 2 | aqueous | 7 | 6 | 138 | 0.03 |
| 8 | 8 | NPC | 1 | 75.5 | 70.6 | 80 | 5 | aqueous | 7 | 6 | 136 | 0.01 |
| 9 | 9 | NPC | 1 | 75.5 | 70.6 | 80 | 0.5 | aqueous | 7 | 6 | 142 | 0.07 |
| 10 | 10 | NPC | 1 | 75.5 | 70.6 | 80 | 2 | aqueous | 8 | 6 | 136 | 0.02 |
| 11 | 11 | NPC | 1 | 75.5 | 70.6 | 80 | 2 | aqueous | 9 | 6 | 144 | 0.01 |
| 12 | 12 | NPC | 1 | 75.5 | 70.6 | 80 | 2 | aqueous | 6 | 6 | 136 | 0.04 |
| 13 | 13 | NPC | 1 | 75.5 | 70.6 | 80 | 2 | aqueous | 5.5 | 6 | 134 | 0.06 |
| 14 | 14 | NPC | 1 | 75.5 | 70.6 | 80 | 2 | aqueous | 7 | 7 | 138 | 0.03 |
| 15 | 15 | NPC | 1 | 75.5 | 70.6 | 80 | 2 | aqueous | 7 | 8 | 136 | 0.03 |

TABLE 3

| No. | Toner No. | Production process | Crystalline resin No. | Crystalline resin Tm (° C.) | Crystalline resin Rc (° C.) | Dispersion Temperature (° C.) | Dispersion Cooling rate (° C./min) | Dispersion Medium | Dispersion pH (–) | Dispersion Scheme No. | Tf (° C.) | ΔG (–) |
|---|---|---|---|---|---|---|---|---|---|---|---|---|
| Example 16 | 16 | NPC | 1 | 75.5 | 70.6 | 80 | 2 | aqueous | 7 | 9 | 134 | 0.04 |
| Example 17 | 17 | NPC | 2 | 75.0 | 70.8 | 80 | 2 | aqueous | 7 | 6 | 136 | 0.03 |
| Example 18 | 18 | NPC | 2 | 75.0 | 70.8 | 80 | 2 | aqueous | 7 | 10 | 136 | 0.02 |
| Example 19 | 19 | NPC | 3 | 70.0 | 65.8 | 80 | 2 | aqueous | 7 | 11 | 134 | 0.04 |
| Example 20 | 20 | NPC | 3 | 70.0 | 65.8 | 80 | 2 | aqueous | 7 | 12 | 134 | 0.06 |
| Comparative Example 1 | 21 | NPC | 1 | 75.5 | 70.6 | 80 | 2 | aqueous | 10 | 6 | 154 | 0.01 |
| Comparative Example 2 | 22 | NPC | 1 | 75.5 | 70.6 | 80 | 2 | aqueous | 4 | 6 | 134 | 0.10 |
| Comparative Example 3 | 23 | NPC | 1 | 75.5 | 70.6 | 80 | 2 | aqueous | 7 | 13 | 156 | 0.15 |
| Comparative Example 4 | 24 | NPC | 1 | 75.5 | 70.6 | 80 | 2 | aqueous | 7 | 14 | 154 | 0.09 |
| Comparative Example 5 | 25 | NPC | 1 | 75.5 | 70.6 | 80 | 2 | — | — | — | 156 | 0.15 |
| Comparative Example 6 | 26 | SP | 1 | 75.5 | 70.6 | 80 | 2 | aqueous | 7 | 6 | 150 | 0.15 |

It can be seen from Tables 2 and 3 that the toners in Examples 1 to 20, which were produced through retaining a temperature (° C.) of a dispersion containing a particle of a crystalline polyester resin as a binder resin at Rc−25° C. or higher and Rc−5° C. or lower for 30 minutes or longer in a state where a pH of the dispersion is maintained at 5.5 or higher and 9.0 or lower, each had sufficient low-temperature fixability and suppressed density unevenness of images.

The reason for enhanced low-temperature fixability and suppressed density unevenness of images is not clear. Here, a dispersion containing a toner base particle produced by an emulsion aggregation method in the presence of a metal ion was heat-treated in a specific temperature region while the pH of the dispersion was controlled within a specific range. Because of this, it is considered that an amount of ionic crosslinking which aggregates binder resin fine particles or coloring agent fine particles is controlled within a proper range, and consequently excessive increase in a domain diameter of a crystalline resin and/or bleeding out of the crystalline resin onto a toner surface was prevented.

From the comparison between Examples 1 to 3, and Examples 4 and 5, it is found that low-temperature fixability and suppression of density unevenness of images are more favorably achieved when the temperature of the dispersion during the heat treatment is Rc−25° C. or higher and Rc−10° C. or lower. Moreover, from the comparison between Examples 6 and 7, it is found that low-temperature fixability is further enhanced and density unevenness of images is further lowered when the cooling rate of the dispersion at Rc is 2° C./min or higher. Furthermore, from the comparison between Example 7 and Examples 9 to 12, it is found that low-temperature fixability and suppression of density unevenness of images are more favorably achieved when the pH of the dispersion during heat treatment is 6 to 8.

In contrast, in Comparative Example 1 in which the pH of the dispersion during the heat treatment was 10, low-temperature fixability was found poor although density unevenness of images was favorably suppressed. This is presumably due to the excessively high pH and the resulting increased amount of ionic crosslinking among the binder resin fine particles. Also, in Comparative Example 2 in which the pH of the dispersion during the heat treatment was 4, low-temperature fixability was found poor although density unevenness of images was favorably suppressed. This is presumably due to the excessively low pH and the resulting dissociation of acid groups in the binder resin and the lowered amount of ionic crosslinking among the binder resin fine particles.

In Comparative Examples 3 and 4 in which the temperatures of the heat treatment in the second step were outside the range of Rc−25° C. or higher and Rc−5° C. or lower, both low-temperature fixability and suppression of density unevenness of images were found poor. This is presumably due to the heat treatment temperatures outside the specific temperature range, and the resulting increased domain diameter of a crystalline resin and bleeding out of the crystalline resin into the vicinity of a toner surface.

In Comparative Example 5 in which heat treatment was not conducted, both low-temperature fixability and suppression of density unevenness of images were poor. Similarly, in Comparative Example 6, image density was uneven. This is presumably because a toner base particle was produced by a suspension polymerization method, not an emulsion aggregation method, and consequently a presence state of a crystalline resin in a toner during the heat treatment could not be controlled.

INDUSTRIAL APPLICABILITY

The present invention can provide a toner having excellent low-temperature fixability and low density unevenness of images to be obtained even when a crystalline resin is contained. In addition, the present invention is expected to achieve wider application of a toner as well as further higher performance, higher speed, and energy saving in electrophotographic image forming technology, and the image forming technology will further prevail.

What is claimed is:

1. A process for producing a toner comprising:

a first step of heating an aqueous dispersion of fine particles of a binder resin, the binder resin comprising an amorphous resin and a crystalline resin, to a temperature higher than or equal to a melting point of the crystalline resin in the presence of a metal ion, whereby the fine particles of the binder resin are aggregated and fused to form a dispersion of toner base particles; and a second step of maintaining the dispersion of the toner base particles at a temperature T (° C.) for 30 minutes or longer where the dispersion is maintained at a pH of 5.5 or higher and 9.0 or lower, the temperature T satisfying the following expression, $Rc-25 \leq T \leq Rc-5$, wherein the Rc represents a recrystallization temperature (° C.) of the crystalline resin.

2. The process for producing a toner according to claim 1, wherein the temperature T satisfies the following expression, $Rc-25 \leq T \leq Rc-10$.

3. The process for producing a toner according to claim 1, further comprising a step of cooling the dispersion to a temperature lower than Rc−25° C. after the aqueous dispersion is heated to a temperature higher than the Rc in the first step.

4. The process for producing a toner according to claim 1, further comprising a step of cooling the dispersion to a temperature lower than the Rc at a temperature-lowering rate of 1° C./min or higher after the aqueous dispersion is heated to a temperature higher than the Rc in the first step.

5. The process for producing a toner according to claim 1, wherein the crystalline resin is a crystalline polyester resin.

6. The process for producing a toner according to claim 1, wherein the binder resin is a hybrid resin having an amorphous resin segment and a crystalline resin segment, the amorphous resin is the amorphous resin segment of the hybrid resin, and the crystalline resin is the crystalline resin segment of the hybrid resin.

7. The process for producing a toner according to claim 1, wherein the metal ion is a divalent metal ion.

8. The process for producing a toner according to claim 1, further comprising a step of cooling the dispersion to a temperature lower than the Rc at a temperature-lowering rate of 2° C./min or higher after the first step and when the aqueous dispersion is at a temperature of Rc.

9. The process for producing a toner according to claim 1, further comprising a step of cooling the dispersion to a temperature lower than the Rc at a temperature-lowering rate of 5° C./min or higher after the first step and when the aqueous dispersion is at a temperature of Rc.

10. The process for producing a toner according to claim 1, wherein the pH of the dispersion in the second step is 6.0 or higher and 8.0 or lower.

11. The process for producing a toner according to claim 1, wherein a content of the crystalline resin is 3 to 30 mass % based on the toner.

12. The process for producing a toner according to claim 1, wherein the crystalline resin has a melting point of 50 to 90° C.

13. The process for producing a toner according to claim 1, wherein the crystalline resin has a melting point of 60 to 80° C.

14. The process for producing a toner according to claim 1, wherein the toner base particles contain an amorphous polyester resin in an amount of 1 to 50 mass %.

15. The process for producing a toner according to claim 1, wherein the toner base particles have a core-shell structure having a shell layer on a core, and the shell layer contains an amorphous polyester resin modified with a styrene-acrylic resin.

16. The process for producing a toner according to claim 1, wherein a content of the crystalline resin in the binder resin is 5 to 50 mass %.

* * * * *